United States Patent [19]

Cecil, Jr.

[11] 4,182,031

[45] Jan. 8, 1980

[54] RAZOR WITH HANDLE TO STORE A BLADE UNIT OR CARTRIDGE

[76] Inventor: John Cecil, Jr., 25 Leitch Ave., Skaneateles, N.Y. 13152

[21] Appl. No.: 876,862

[22] Filed: Feb. 10, 1978

[51] Int. Cl.[2] ..... B26B 21/52

[52] U.S. Cl. ..... 30/47; 30/86

[58] Field of Search ..... 30/40.2, 47, 86, 125; 16/110.5; 206/352, 354; 132/75; 145/61 J, 62

[56] References Cited

U.S. PATENT DOCUMENTS

| | | | |
|---|---|---|---|
| 858,131 | 6/1907 | Aichele | 145/62 |
| 1,824,203 | 9/1931 | Fisher | 30/86 X |
| 3,880,284 | 4/1975 | Pomfret | 30/40.2 X |
| 3,967,375 | 7/1976 | Hoffschmidt | 30/86 X |
| 4,034,892 | 7/1977 | Braginetz | 30/40.2 X |
| 4,047,295 | 9/1977 | Francis | 30/40.2 |

FOREIGN PATENT DOCUMENTS

| | | | |
|---|---|---|---|
| 2203235 | 8/1973 | Fed. Rep. of Germany | 30/86 |
| 1445986 | 8/1976 | United Kingdom | 30/47 |

*Primary Examiner*—Gary L. Smith

*Attorney, Agent, or Firm*—Cumpston & Shaw

[57] ABSTRACT

The razor is of the type which has on its head a generally T-shaped fitting on which a conventional razor blade unit can be releasably mounted by urging the fitting into a correspondingly shaped channel or recess formed in the back of the blade unit. The blade unit can be removed from the head and stored in a generally rectangularly-shaped aperture formed through the razor handle intermediate its ends. An elongate rib is formed on one side wall of the aperture, and a cam lug is formed on the other side wall so that when the blade unit is forced into the opening the cam lug urges the channel of the blade unit releasably over the rib, thereby positively to hold the blade unit in the handle until forced therefrom by finger pressure or the like.

5 Claims, 3 Drawing Figures

RAZOR WITH HANDLE TO STORE A BLADE UNIT OR CARTRIDGE

Figure 1:
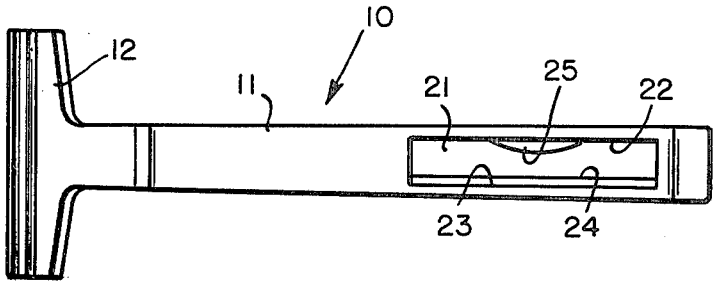

This application relates to shaving razors, and more particularly to a novel razor which has in its handle a special receptacle for storing a razor blade unit assembly or cartridge, when not in use.

In recent years most major razor manufacturers have developed razors which utilize a removable blade unit assembly of the type in which the blade is permanently secured in a plastic housing, and which is releasably mountable onto the head coupling structure of the razor. One advantage of using this system is that, at the time of producing the blade unit housing, the associated razor blade is fixed in a predetermined geometrical relationship to the guard surface on the blade unit housing, so that the exposed shaving edge of the blade will be consistently uniform from blade unit to blade unit. As a result there is very uniform shaving quality from blade unit to blade unit.

Another advantage lies in the method of manufacture of such blade units in that certain metallurgical, sharpening and blade coating processes have improved the efficiency of the blade cutting action and by so doing permit a greater number of practical uses (i.e., shaves) from the same blade unit. Thus, since a blade unit can be kept in longer service than prior to such processing practice, it becomes reasonable to consider optimum storage means for the blade unit/handle shaving system.

Disclosures relating to one type of razor blade unit, as well as related shaving equipment, can be found in U.S. Pat. No. 3,783,493; No. 3,754,326; and U.S. Pat. No. Des. 227,234; No. Des. 226,553 and No. Des. 230,223. Still another similar type of blade unit is disclosed in U.S. Pat. No. 3,832,774. In all cases, there is little significant difference in the external configuaration of any of the blade units disclosed in the above-noted patents. Each such blade unit, for example, is releasably attached to the head of the associated razor by means of a conventional tongue and groove type connection, wherein a surface on the head of the razor, which is generally T-shaped in cross-section, is laterally slideable into a complementary-shaped notch or channel formed in the back of the razor blade unit, and held in proper location by a spring loaded detent feature either of metal or plastic.

Since the cutting blade elements are permanently fixed to these types of blade unit assemblies, storage becomes a problem, because not only the blade but the unit assembly housing itself must be stored. Although a variety of blade unit dispensers or holding devices have been developed for holding or storing a plurality of such blade units, no satisfactory or convenient way for storing individual blade units without the use of an additional container or guard component has been discovered.

For example, in the case of known blade unit dispensing and/or storage devices, the storage unit usually comprises a plastic housing having a plurality of recesses, each of which is adapted to have one razor blade unit stored therein. Such devices are rather bulky and awkward to store in a medicine cabinet, travel kit, or the like. If one wishes to remove a razor blade unit from the head of a razor, when not in use, as for example when travelling, it becomes necessary either to store the blade unit temporarily in a rather bulky dispenser of the type noted above, or presumably the blade unit can be enclosed in some other form of container, or perhaps can be wrapped in paper, or the like, so that its exposed blade will not cause accidental injury. The disadvantage of this, however, is that the blade unit may be lost or misplaced after being separated from the head of the razor, and the multiple chambered storage of devices heretofore available are more bulky and, thus, offer an inconvenience to the user.

Heretofore razors have been designed to include storage space for new and/or old blades, as disclosed for example in U.S. Pat. No. 1,652,685; No. 1,712,668; No. 1,734,521; No. 1,756,439; No. 1,791,550; No. 2,281,166; No. 2,694,856; No. 2,834,105 and No. 3,967,375. None of these patents, however, was concerned with storing a cartridge of the type noted above, wherein the blade was permanently fixed to a unit assembly housing having a special mounting channel or similar component assembly means for securing the blade unit to the razor handle coupling structure.

It is an object of this invention, therefore, to provide improved means for storing a razor blade unit of the type described, when not in use. To this end, it is an object also of the invention to provide such storage means as an integral part of the handle of the razor itself.

Another object of this invention is to provide an improved razor of the type described which has means thereon for holding two razor blade units; one in active position, and one in an inactive or stored position.

Still another object of this invention is to provide on the handles of razors of the type that use replaceable blade units, novel storage means for releasably holding a blade unit, when not in use, with the cutting edge or edges of the blade unit hidden from sight so that such edges can not cause injury or be damaged while stored.

Other objects of this invention will be apparent hereinafter from the specification and from the recital of the appended claims, particularly when read in conjunction with the accompanying drawing.

Figure 2:
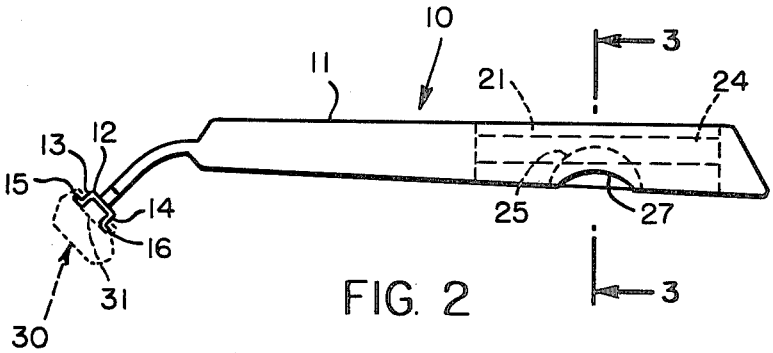
Figure 3:
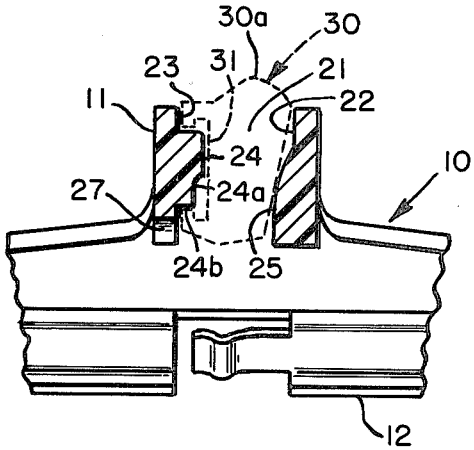

In the drawing:

FIG. 1 is a plan view of a razor having in the handle portion thereof novel blade unit storing means of the type made according to one embodiment of this invention;

FIG. 2 is a side elevation view of this razor with an associated razor blade unit being illustrated in phantom by broken lines on the coupling structure of the razor handle; and FIG. 3 is an enlarged, fragmentary sectional view taken along the line 3—3 in FIG. 2, looking in the direction of the arrows, and illustrating in broken lines the position of the razor blade unit when it has been removed from the razor's coupling structure and stowed in the storage chamber embodied as part of the razor handle.

Referring now to the drawing by numerals of reference, 10 denotes a razor of generally conventional configuration, having an elongate handle or hand grip portion 11, and an integral head or coupling structure portion 12, which extends at right angles to the handle portion. The head or coupling structure 12 is generally U-shaped in cross section, and has thereon a pair of spaced, parallel, longitudinally extending rails 13 and 14, which have marginal flanged edges 15 and 16, respectively, that are rolled or otherwise formed laterally outwardly and away from each other as illustrated in FIG. 2.

Adjacent the end thereof remote from its head coupling structure, handle 11 has therethrough an elongate, generally rectangular opening or aperture 21 having opposed side surfaces 22 and 23, which extend generally parallel to one another and to the sides of handle 11. Integral with handle 11 and projecting into the aperture 21 from one side surface 23 thereof is an elongate rib 24. Rib 24 is generally rectangular in cross section, except for an entry locus relief 24*a* on its lower inside cross-sectional corner as shown in FIG. 3, and preferably extends the entire length of the aperture 21 approximately medially of the upper and lower edges of its side surface 23. Although rib 24 preferably extends continuously for the full length of aperture 21, rib 24 may be comprised of axially aligned discontinuous sections (not shown).

Also, projecting into the opening 21 from the opposite side surface 22 thereof and opposite rib 24 is an integral boss or cam lug 25, which is preferably generally segmentally spherical in configuration, although other equally effective ramp type configurations may be used. The upper edge of cam lug 25 (FIGS. 2 and 3) is spaced beneath the upper edge or surface of the handle 11. Commencement of this upper bound of the cam lug feature is also positioned relative to the medial elevation of rib 24 such that no contact interference is made with the cutting blade elements when the blade unit is within aperture 21 in stored configuration (see FIG. 3). Moreover, also as shown more clearly in FIG. 3, the inclined or curved outer cam surface of cam lug 25 projects deeper into the opening 21 as the cam lug surface approaches the lower end (FIG. 3) of opening 21.

In use, the razor 10 is adapted to have a conventional razor blade unit 30 releasably attached to its head 12, as shown for example by broken lines in FIG. 2. For this purpose, blade unit 30 comprises a housing 30*a* having in one surface thereof an elongate groove 31, which is generally T-shaped in cross-section, in order releasably to engage and grip complementarily-shaped formed flanges 15 and 16 of the head coupling structure rails 13 and 14. For a more detailed illustration of how the blade unit 30 can be releasably inserted onto and removed from head coupling structure 12 of the razor, reference is made to above-noted U.S. Pat. No. 3,783,493; No. 3,768,162; and No. 3,832,774.

When blade unit 30 is not is use, it can be stored in aperture 21 in handle 11 as illustrated in FIG. 3, wherein the blade unit 30 is again denoted in phantom by broken lines. As shown in FIG. 3, the thickness of the blade unit 30 differs slightly in cross-section, so that it is somewhat thinner adjacent its lower edges (FIG. 3) and slightly wider adjacent its upper edges. The narrower portion of the blade unit is therefore inserted downwardly into aperture 21 with the groove 31 in the blade unit facing the rib 24, so that when the cartridge has been pressed downwardly into its fully seated position as shown in FIG. 3, the marginal edges of its groove 31 will snap over opposite, longitudinal side edges of the rib 24, thereby positively to hold the blade unit in a stored or inactive position in the handle. In this position, the cam lug 25 urges the blade unit resiliently toward the left, so that the rib 24 remains engaged in the groove 31 until such time that the blade unit is to be removed. Locus relief 24*a* reduces the amount of interference or overlap between the blade unit and inside walls of aperture 21 when the blade unit is moved into its stored position shown in FIG. 3. This reduces the spreading of opposite side surfaces 22 and 23 while still providing a positive lip or abuttment 24*b* against which the lower marginal edge of groove 31 bears when the blade unit is in its fully stored position, and which also prevents the blade unit from being inadverently moved upwardly out of aperture 21.

The blade unit 30 can be removed from handle 11 merely by pushing against its underside and forcing it first laterally, then upwardly in aperture 21 until opposite sides of its groove 31 become disengaged from the rib 24, and allow upward withdrawal of the blade unit from the top of the aperture 21. To facilitate this operation, the lower edge of handle 11 is scalloped out or recessed as at 27 (FIGS. 2 and 3) between the lower edge of surface 23 and the outside surface of the handle to accommodate one's finger.

In practice, the handle 11 may be made from a plastic material which enables the portions of the handle bounding the sides of aperture 21 to flex slightly, so that the marginal edges of the groove 31 in the blade unit 30 can be engaged with, or disengaged from rib 24 by means of relatively slight but firm pressure exerted against the blade unit. Though plastic material is suggested for the preferred embodiment, the same principle can be achieved using metallic springs or a combination of metal, plastic or elastomeric material to effect the same principle. As noted above, the blade unit is slightly wider adjacent its upper edge, so that it will properly fit into aperture 21 only when its narrower edge is inserted downwardly as shown in FIG. 3. To assist the user in knowing how to insert the cartridge into the aperture 21, a legend or other indicia may be printed along one of the edges of the blade unit and/or the handle 11 to indicate the proper way to insert the cartridge into the opening. However, once shown, either by the above indicia or on the sales or display package, the criteria: groove 31 to rail 24 with thinned edge down provides the necessary orientation.

From the foregoing, it will be apparent that the instant invention provides relatively simple and inexpensive means for temporarily storing a razor blade unit of the type described in the handle of the razor with which it is intended to be used. This obviates the need for using the more cumbersome storage or dispensing devices currently available, and also assures that the blade unit will not become accidentally separated from the associated razor when it is not operatively mounted on the head thereof. A further advantage of this means of storing the blade unit is that the cutting edge of the blade or blades fixed to the blade unit, is disposed within the aperture 21 when the blade unit is stored, thereby preventing any accidental injury to a person or damage to the cutting edge of the blade or blades. Also, since the aperture 21 extends completely through the handle, it provides good drainage and air circulation for the blade unit to aid in the prompt drying of the same. This improves the life of the blade and results in a more sanitary, protected storage than was heretofore possible. In addition, it is not necessary to pry out the blade unit 30 from the aperture 21, as by inserting one's finger or an instrument into the top of the opening, but on the contrary one need only exert slight pressure against the underside (FIG. 3) of the blade unit to cause it to pop out of the storage receptacle.

While this invention has been described in connection with a razor having a storage receptacle or opening suitable for use with a particular type of razor blade unit, it will be apparent that this invention is equally applicable to other types of razors which use razor blade units generally of the type illustrated and described herein. For example, blade units of the type disclosed in U.S. Pat. No. 3,832,774 can be stored in a similar aperture formed in the handle of the razor with which this latter type blade unit is adapted to be used, such as that described in U.S. Pat. No. 3,768,162 and U.S. Pat. No. Des. 224,481. This latter blade unit, it will be noted, also has therein a generally T-shaped channel for attaching it to the T-shaped head coupling structure of the associated razor. Since this last mentioned blade unit is otherwise generally similar to that illustrated in FIGS. 2 and 3, it obviously could be stored in a manner similar to that disclosed in this application. Likewise, it will be readily apparent that, by modest changes in the dimensions of the items 21, 23, 24 and 25, other blade units of slightly different configuration could likewise be stored in the handles of their associated razors by following the teachings herein.

While this invention has been illustrated and described in connection with only certain embodiments thereof, it will be apparent that it is capable of still further modification, and that this application is intended to cover any such modifications that may fall within the scope of one skilled in the art or the appended claims.

Having thus described my invention, what I claim is:

1. In a combination of a razor and a razor blade unit of the type having an elongate housing, at least one blade mounted on said housing, and recessed fastening means on one side of said housing releasably engageable with complementary means on the head of the razor for releasably attaching the blade unit in an operative position on the razor, an improved razor comprising a head having thereon said complementary means for releasably attaching thereto said blade unit, and an elongate handle integral at one end with said head and projecting transversely therefrom, said handle having therethrough intermediate its ends an elongate aperture for releasably holding said blade unit in a stored position in said handle upon insertion of said unit downwardly into said aperture, said aperture being approximately equal in length to the length of said blade unit, and having opposed, generally parallel sidewalls separated from each other a distance approximately equal to the width of said blade unit housing, a first projection integral with one sidewall of said aperture and projecting into said aperture for engagement in a recess in said fastening means when the blade unit housing is stored in said handle, and a second projection integral with the opposite sidewall of said aperture and projecting thereinto in spaced, generally confronting relation with said first projection to engage the side of said blade unit housing opposite said recess, thereby releasably to hold the blade unit seated in its stored position over said first projection, said aperture and projections being configured to allow insertion of said blade unit into said stored position only when said blade unit is disposed in a single, predetermined position relative to said projections.

2. The improved razor as defined in claim 1, wherein said aperture extends completely through said handle.

3. The improved razor as defined in claim 2, wherein said first projection comprises a rib extending longitudinally of said aperture, and said second projection comprises a cam lug formed on said opposite sidewall intermediate the ends thereof, and beneath the upper end of said aperture, and having an inclined outer surface projecting into said aperture adjacent the lower end thereof.

4. The improved razor as defined in claim 3, wherein an arcuate recess is formed in the underside of said handle intermediate the ends of said aperture and opening thereon to accommodate the tip of a person's finger during removal of said blade unit housing from said aperture.

5. In a combination of a razor of the type having an elongate handle and transverse head with a fitting thereon for releasably holding a razor blade unit on said head, and a conventional razor blade unit of the type having therein a complementarily-shaped recess releasably engageable by said fitting, the improvement comprising means for releasably storing said blade unit in an elongate aperture in said handle, said aperture extending parallel to the length of said handle, said means including at least one elongated rib formed on one sidewall of said aperture and being slightly smaller than said recess in said blade unit thereby to project into said recess for engagement with side edges thereof only when the blade unit is properly seated in said aperture, and a cam lug projecting from the opposite side wall of said aperture in spaced relation to said rib and disposed to engage said blade unit on the side thereof opposite said recess releasably to hold the rib seated in the recess when the blade unit is fully and properly seated in said aperture, said cam lug being positioned on said opposite side wall beneath said one end of said aperture, and being spaced from said rib a distance less than the maximum width of said blade unit, thereby to prevent the blade unit from passing completely through said aperture; and said aperture, said cam lug and said rib being configured to allow insertion of said blade unit into its fully seated position only when said blade unit is disposed in a single predetermined position relative to said cam lug and rib.

* * * * *